US005080514A

United States Patent [19]

Inoue

[11] Patent Number: 5,080,514

[45] Date of Patent: Jan. 14, 1992

[54] PIN-FEED APPARATUS FOR RECORDING SYSTEMS

[75] Inventor: Hiroyuki Inoue, Narashino, Japan

[73] Assignee: Canon Kabushiki Kaisha, Tokyo, Japan

[21] Appl. No.: 418,991

[22] Filed: Oct. 6, 1989

Related U.S. Application Data

[63] Continuation of Ser. No. 267,631, Oct. 31, 1988, abandoned, which is a continuation of Ser. No. 911,764, Sep. 26, 1986, abandoned.

[30] Foreign Application Priority Data

Oct. 2, 1985 [JP] Japan ..... 60-219672

[51] Int. Cl.[5] ..... B41J 11/27

[52] U.S. Cl. ..... 400/616.1; 400/616.3; 400/617; 226/79

[58] Field of Search ..... 400/617, 619, 616, 616.1, 400/616.2, 616.3, 633, 633.2, 645.3, 647; 271/226, 240, 249, 238, 253, 279; 226/79, 86

[56] References Cited

U.S. PATENT DOCUMENTS

| | | | |
|---|---|---|---|
| 116,616 | 7/1871 | Mauger | 400/616.1 X |
| 487,513 | 12/1892 | Briggs | 271/240 |
| 733,325 | 7/1903 | Krehbiel | 400/616.1 X |
| 2,268,891 | 1/1942 | Mueller | 271/2.3 |
| 2,586,522 | 2/1952 | Dobson | 400/633.2 |
| 4,238,160 | 12/1980 | Kindur, Sr. | 400/616.3 |
| 4,242,006 | 12/1980 | Kondur, Jr. | 400/616.1 X |
| 4,566,618 | 1/1986 | Seitz et al. | 400/616.1 X |
| 4,569,468 | 2/1986 | Neer | 400/616.1 X |
| 4,729,682 | 3/1988 | Morita | 400/616.1 X |

FOREIGN PATENT DOCUMENTS

| | | | |
|---|---|---|---|
| 2700668 | 7/1978 | Fed. Rep. of Germany | 400/616 |
| 2817188 | 10/1979 | Fed. Rep. of Germany | 271/2.3 |
| 812422 | 1/1982 | Japan . | |
| 58-104658 | 7/1983 | Japan . | |
| 756310 | 9/1956 | United Kingdom | 271/2.3 |

OTHER PUBLICATIONS

IBM Tech. Disc. Bulletin, "Lost Cost Paper Aligner", Lee et al., vol. 22, No. 12, May 1880, p. 5228.

IBM Tech Disc. Bulletin, "Forms Alignment Link", Neer, vol. 27, No. 7B, Dec. 1984, pp. 4222–4223.

*Primary Examiner*—Edgar S. Burr

*Assistant Examiner*—Ren Yan

*Attorney, Agent, or Firm*—Fitzpatrick, Cella, Harper & Scinto

[57] ABSTRACT

The present invention provides a pin-feed apparatus suitable for use in a recording system, including pin-wheels adapted to operatively engage perforations on a sheet to be carried through the recording system, at least one of the pin-wheels being adjustably movable away from and toward the other pin-wheel in the direction of sheet width by resilient engagement of openings with spring pieces, at least one of the openings having such a size that it provides a play when that opening is engaged by the corresponding spring piece.

11 Claims, 4 Drawing Sheets

PIN-FEED APPARATUS FOR RECORDING SYSTEMS

This application is a continuation of Ser. No. 267,631, filed Oct. 31, 1988, now abandoned, which is a continuation of Ser. No. 911,764, filed Sept. 26, 1986, now abandoned.

BACKGROUND OF THE INVENTION

1. Field of the Invention

The present invention relates to a pin-feed apparatus for carrying a sheet with perforations through a recording system such as printer, facsimile or typewriter.

2. Related Background Art

A sheet carrier mechanism for recording systems may use a pin-feed apparatus for carrying a sheet (recording medium such as a sheet of paper, plastic or the like) in a stable manner. The pin-feed apparatus includes pin-shaped means adapted to cooperate with perforations on the opposite side edges of a continuous sheet such as a fan-folded sheet or the like.

Such a pin-feed apparatus is of either a pin-wheel type or a pin-tractor type. Usually, pin-wheels or pin-tractors are disposed one on each side of the path of sheet movement. The pin-wheels or pin-tractors are rotatably supported on a pin-feed body and driven by a pin-feed shaft which may serve also as a platen drive shaft.

The arrangement of such a pin-feed apparatus may be of a coaxial type in which the pin-feed apparatus is disposed coaxially on a platen roller (sheet carrying roller), a press-in type in which the pin-feed apparatus is located in front of the recording station or a pull-out type in which the pin-feed apparatus is positioned at the outlet of the recording station.

The pin-feed apparatus must handle different widths of sheets and may have such a construction that the spacing between the pin-wheels or pin-tractors can be adjusted.

However, the prior art pin-feed apparatus having the above construction comprises a guide shaft extending parallel to the pin-feed shaft and a locking lever for locking the pin-feed body after the position thereof has been confirmed by observing matching marks. This raises problems in that the positioning operation is troublesome and in that the construction is complicated with an increased number of components resulting in increase of cost in manufacturing.

Japanese Utility Model Application 494/1982 (Laid Open 104658/1983), assigned to the assignee, discloses a construction of the pin-feed apparatus which intends to simplify the positioning operation and to reduce the cost in manufacturing. Such a construction comprises a shaft guiding the pin-tractors and including grooves formed thereon in place and ball means located on the pin-tractors and urged against the shaft under the action of spring means, whereby the ball means can engage into the grooves to position the pin-tractors in place in a click manner. However, this construction of the pin-feed apparatus also has a disadvantage in that jamming of the sheet is easily created if the spacing between the lines of perforations on the sheet has an accidental error or if there is any change in the width of the sheet due to change of the circumstance around the pin-feed apparatus.

SUMMARY OF THE INVENTION

It is therefore an object of the present invention to provide a pin-feed apparatus which can minimize the jamming of the sheet.

Another object of the present invention is to provide a pin-feed apparatus which can accommodate an error in the spacing between the lines of perforations in the direction of sheet width.

Still another object is to provide a pin-feed apparatus in which various different widths of sheets can be charged in an improved manner.

A further object is to provide a pin-feed apparatus including a reduced number of components and having a simplified construction.

These and other objects will more fully be apparent from reading the following description of the present invention in connection with the drawings.

DETAILED DESCRIPTION OF THE PREFERRED EMBODIMENTS

The present invention will now be described concretely with reference to the drawings.

Figure 1:
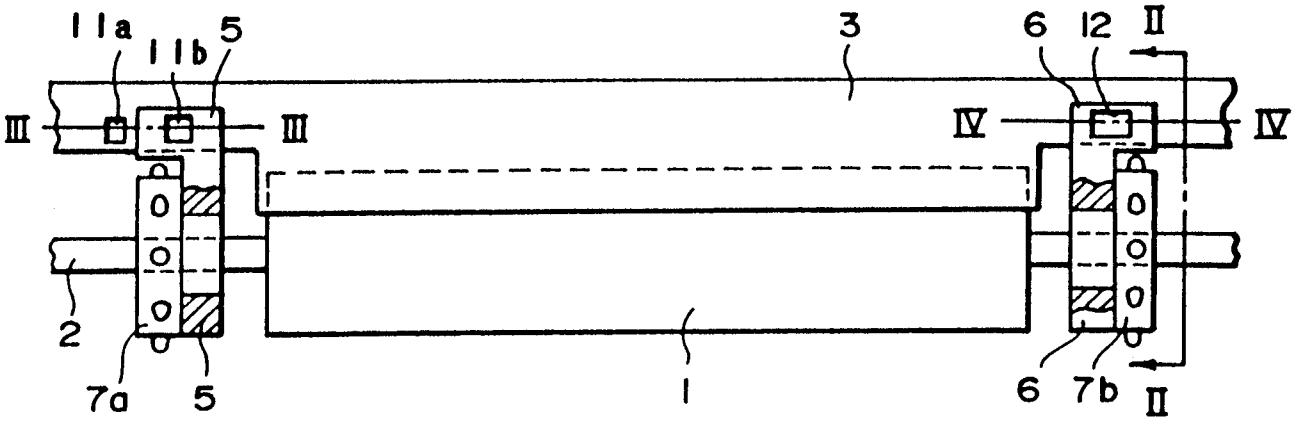
FIG. 1 is a plan view of a first embodiment of a pin-feed apparatus in accordance with the present invention.

Referring to FIG. 1, there is shown a first embodiment of a pin-feed apparatus in accordance with the present invention which comprises a platen roller 1 rotatably supported on the base of a recording system (not shown) through a platen shaft 2. As the platen shaft 2 is rotatably driven by a motor, the platen roller 1 also is rotated to move a sheet of paper or plastic under the action of a frictional force.

Figure 2:
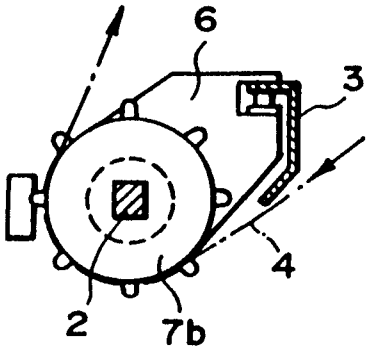
FIG. 2 is a side view of the pin-feed apparatus as viewed along the line of arrow II—II in FIG. 1.

Referring further to FIG. 1 with FIG. 2, a cover 3 is located behind the platen roller 1 and extends parallel to the same. The cover 3 serves as a blind for concealing the internal mechanism of the pin-feed apparatus and also as guide means for partially guiding a continuous sheet 4 being carried as shown by broken lines in FIG. 2. The cover 3 is rigidly mounted on the base of the recording system.

Furthermore, the cover 3 also is utilized as a guide member in the present invention, as will be described.

Pin-feed bodies 5 and 6 are provided on the opposite ends of the platen roller 1. The pin-feed bodies 5 and 6 rotatably support pin-wheels 7*a* and 7*b* co-operating with perforations on the continuous sheet 4, respectively.

The pin-wheels 7*a* and 7*b* are mounted coaxially on the platen shaft 2 so that they will be driven by the rotation of the platen shaft 2 together with the platen roller 1.

In front of the platen roller 1 there is provided a recording head 15 defining a recording section.

Each of the pin-feed bodies 5 and 6, together with its associated pin-wheel 7*a* or 7*b*, is slidable on the platen shaft 2 within a predetermined range of limit in the direction of sheet width (that is, in the axial direction of the platen roller 1).

Figure 3:
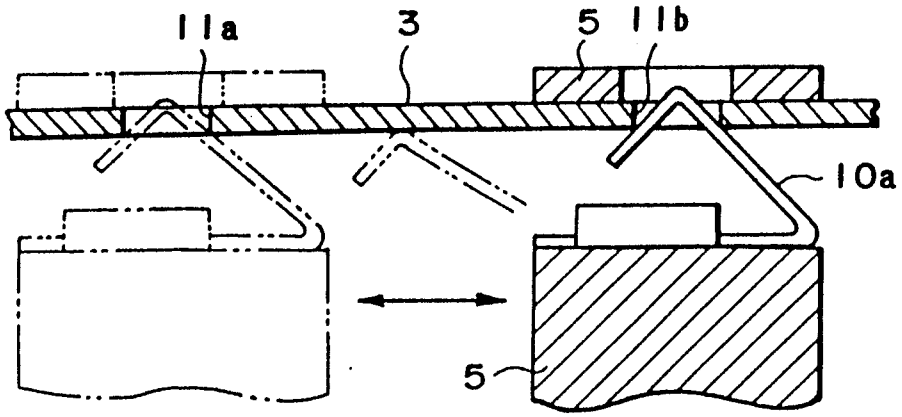
FIG. 3 is a fragmentary enlarged cross-sectional view of the pin-feed apparatus taken along a line III—III in FIG. 1.
Figure 4:
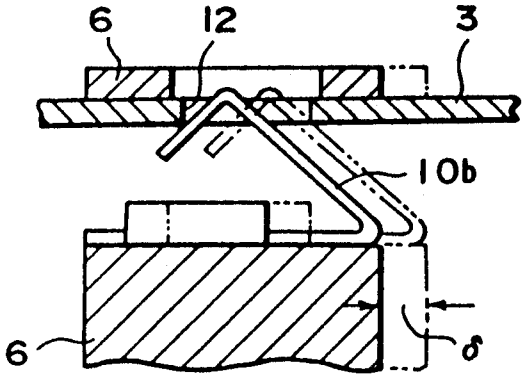
FIG. 4 is a fragmentary enlarged cross-sectional view of the pin-feed apparatus taken along a line IV—IV in FIG. 1.

Referring to FIGS. 3 and 4 in addition to FIG. 1, each of the pin-feed bodies 5 and 6 is provided with a bifurcation having upper and lower portions between which part of the cover (guide member) 3 is located. Click springs 10*a*, 10*b* which are in the form of left springs serve as engaging means mounted on the lower portion of the bifurcation on each of the pin-feed bodies 5 and 6, respectively.

On the other hand, the guide member (cover) 3 is formed with a desired array of openings (or recesses or regulating) 11*a*, 11*b* and 12 which are respectively adapted to engage the click springs 10*a*, 10*b*to regulate the movement of the pin-feed bodies. The openings 11*a*, 11*b* and 12 (i.e. second, third, and first regulating means, respectively) define the other engaging means. The openings are defined by opposed edges or abutment portions.

In the first illustrated embodiment, the left-hand pin-feed body 5 includes two openings 11*a*, 11*b* spaced apart from each other by a distance corresponding to a range of adjustment in the sheet width while the right-hand pin-feed body 6 is formed with a single opening 12.

Thus, a click mechanism for clickingly positioning the respective pin-feed body 5 or 6 is defined by the pin-feed body 5 or 6 slidable in the direction of sheet width, the click springs 10*a*, 10*b* located between the pin-feed body 5 or 6 and the guide member 3 and the openings 11*a*, 11*b* or 12 co-operating with the click springs 10*a*, 10*b*.

The left-hand click mechanism (10*a* and 11*a*, 11*b*) has no play in its engaging area as shown in FIG. 3. Thus, the pin-feed body 5 will be held relative to each of the openings 11 without play. On the other hand, the right-hand click mechanism (10*b* and 12) has a single opening 12 in the form of an elongated slot which provides a play δ (for example, about one millimeter) in the direction of sheet width.

The operation of setting a sheet in the recording system will now be described.

The left-hand pin-feed body is first engaged in any one of the openings on the guide member to match the width of a sheet selected. Thus, the distance between the pin-wheels is maintained equal to the width of the sheet. Therefore, the perforations on the sheet can easily be engaged over the pins of the pin-wheels. Even if there is any error in the spacing between the lines of perforation on the sheet or even if there is any change in the width of the sheet due to change of the circumstance, the pin-feed mechanism can accommodate such a change since the pin-wheel 7*b* is easily moved within the range of the play δ in the right-hand opening 12. Therefore the sheet can very simply be set in the pin-feed mechanism. Furthermore, even if the distance between the lines of perforation on the sheet varies during the movement of the sheet, such a variation can automatically be accommodated by the movement of the pin-wheel 7*b* relative to the opening 12.

In such a manner, the present invention provides a mechanism for adjusting the spacing between the pin-wheels 7*a* and 7*b* in response to the width of the selected sheet and yet which is simplified with the reduced number of components. Moreover, any error or shrinkage of the sheet width can automatically be accommodated by the play δ in the right-hand click mechanism (10 and 12). Thus, any trouble including sheet jamming can positively be prevented.

Figure 5:
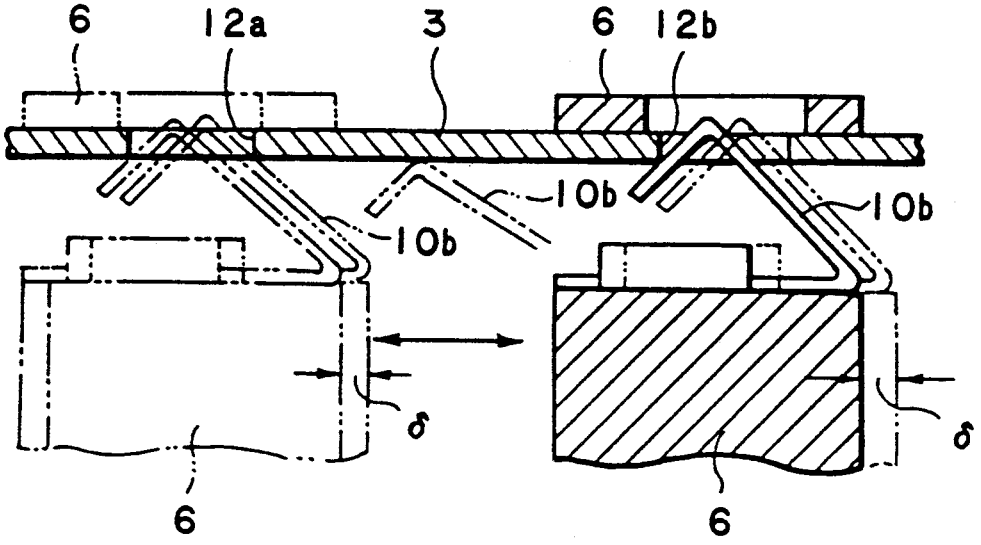
FIGS. 5 and 6 are fragmentary cross-sectional views of a second embodiment of the pin-feed apparatus in accordance with the present invention.
Figure 6:
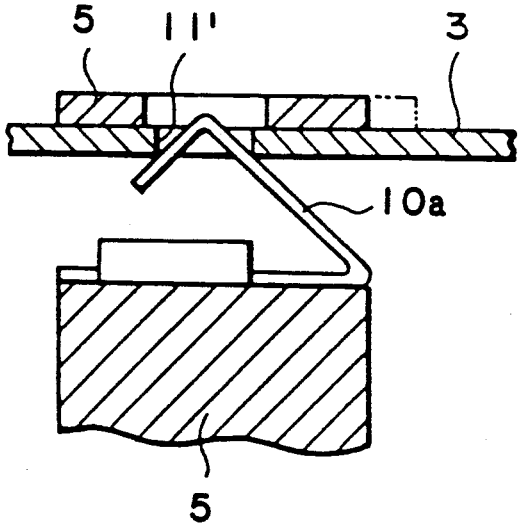

Although both the pin-feed bodies 5 and 6 are movable in the first embodiment of the present invention, it falls within the scope of the present invention that one of the pin-wheels is stationary. Such a construction is shown in FIGS. 5 and 6 illustrating a second embodiment of the present invention. In the second embodiment, the pin-feed body 6 is movable to one of a plurality of elongated slots 12*a* and 12*b* for providing a play δ in the click mechanism. On the other hand, the pin-feed body 5 is stationary and co-operates with an opening 11' having no play.

Although the first and second embodiments have been described as having two openings 11*a*, 11*b* or slots 12*a*, 12*b* matching two different widths of the sheets, the number of openings or slots can be changed with increase of the number of sheet widths.

Figure 7:
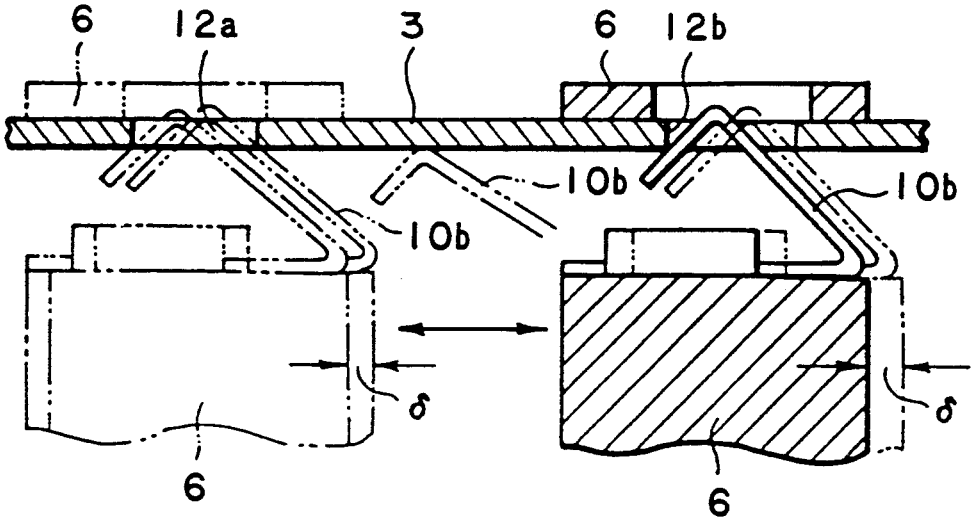
FIGS. 7 and 8 are fragmentary cross-sectional views of a third embodiment of the pin-feed apparatus in accordance with the present invention.
Figure 8:
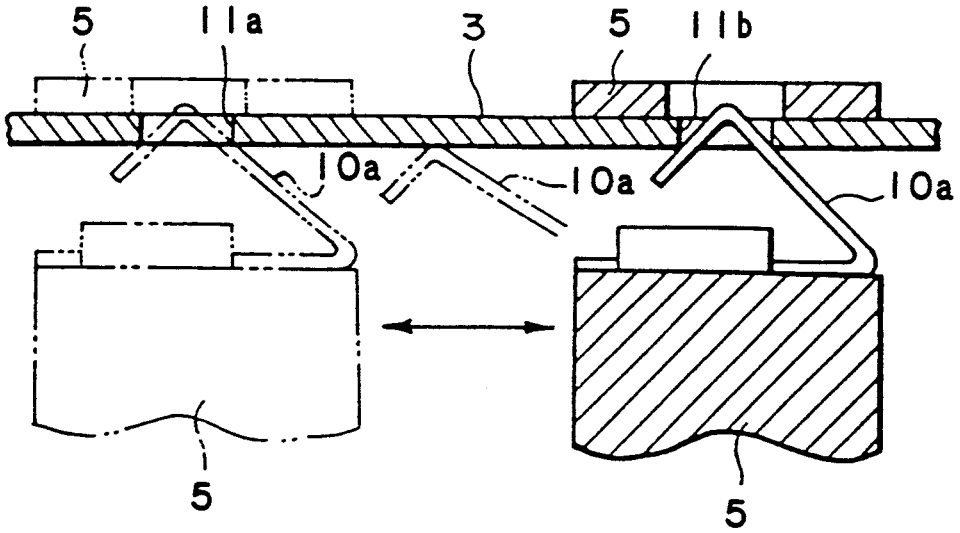

Furthermore, each of the right- and left-hand click mechanisms may have a plurality of adjusting positions, respectively. Such an example is shown in FIGS. 7 and 8 illustrating a third embodiment of the present invention. The right-hand click mechanism includes elongated slots 12*a*, 12*b* each having a play δ while the left-hand click mechanism includes openings 11*a*, 11*b* each having no play. Similarly, the spacing between a slot and the corresponding opening is established to match the width of a sheet to be set.

Figure 9:
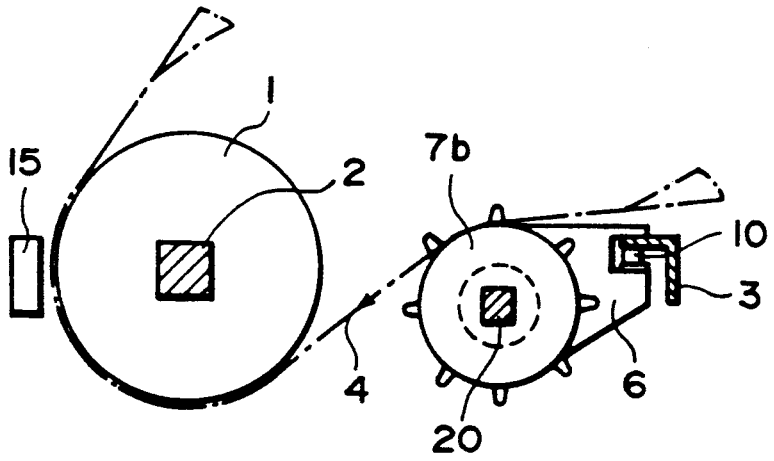
FIG. 9 is a side view similar to FIG. 2, showing a fourth embodiment of the pin-feed apparatus in accordance with the present invention.

FIG. 9 shows a fourth embodiment of a pin-feed apparatus according to the present invention which is disposed at a position forwardly spaced away from the platen roller 1, that is, the recording station. A drive shaft 20 drivingly supporting the pin-wheels 7*a* and 7*b* extends parallel to the platen shaft 2, but rotatably supported at a position remote from the platen shaft 2. The guide member 3 also is located at a position spaced away from the platen roller 1. The remaining components are substantially similar to those of the first to third embodiments and designated by the similar reference numerals without further description.

Figure 10:
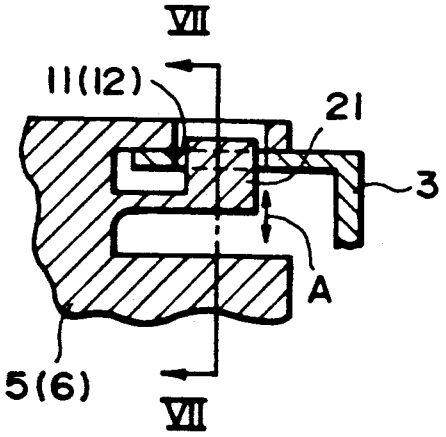
FIGS. 10 and 11 are longitudinal and transverse sectional views of a fifth embodiment of the pin-feed apparatus in accordance with the present invention, showing a modified construction of the click mechanism as shown in the first to fourth embodiments.
Figure 11:
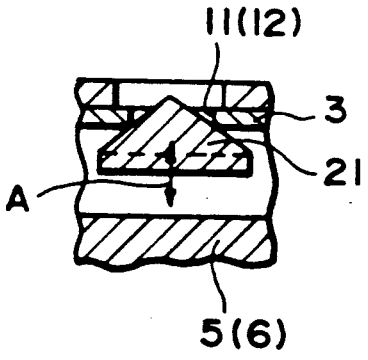

FIGS. 10 and 11 show a fifth embodiment of a pin-feed apparatus according to the present invention. In the fifth embodiment, each of pin-feed bodies 5 and 6 is a molded part of plastics including a bifurcated portion formed integrally with a resilient abutment 21 which is deformable in the direction of arrow shown by A.

On the other hand, a guide member 3 includes a desired array of openings 11 and 12 each of which is engaged by the corresponding abutment 21 to position the pin-feed body 5 or 6 at an adjustment position matching the width of a sheet selected.

Namely, such a click mechanism includes a resilient molded abutment in place of the click springs 10 in the previously described embodiments. However, the remaining parts are substantially the same as those of the first to fourth embodiments.

The click mechanism shown in FIGS. 10 and 11 can have the further reduced number of components and also save the number of steps in manufacturing and/or assembling.

Although the present invention has been described as to the pin-feed apparatus including the pin-wheel *7a* and *7b*, it may similarly be applied to a pin-tractor type pin-feed system which utilizes an endless belt including a plurality of pins thereon.

Although the first to third embodiments have been described as having the pin-feed apparatus disposed coaxially on the platen roller 1 and the fourth embodiment has been described as having the press-in type pin-feed apparatus disposed forwardly away from the recording station, the present invention may similarly be applied to any one of various types of pin-feed systems including a pullout type pin-feed system which is disposed adjacent to the outlet side of the recording station.

Furthermore, the present invention may be applied to any one of various recording systems which may be of thermal type, wiredot type or ink-jet type.

The number and position of openings 11 and 12 on the guide member 3 may optionally be selected in response to the number of different widths of sheets to be used.

I claim:

1. A pin feed apparatus comprising:

first feeding means for feeding a sheet by engaging with a hole formed at one side of the sheet;

second feeding means for feeding the sheet by engaging with a hole formed at the other side of the sheet;

support means for supporting said first and second feeding means movably in opposing directions substantially orthogonal to a sheet feed direction;

first engaging means provided on said first feeding means;

first regulating means provided on said support means and engaging said first engaging means for regulating movement of said first feeding means in the opposing directions substantially orthogonal to the sheet feed direction, said first regulating means having a first abutment portion for regulating movement of said first feeding means in one of the opposing directions orthogonal to the sheet feed direction by abutting against said first engaging means, and a second abutment portion for regulating movement of said first feeding means in an opposite direction of said one of the opposing directions by abutting against said first engaging means, said first and second abutment portions being so constructed as not to abut against said first engaging means simultaneously;

second engaging means provided on said second feeding means;

second regulating means provided on said support means and engaging said second engaging means for regulating movement of said second feeding means in the directions substantially orthogonal to the sheet feed direction, said second regulating means having a third abutment portion for regulating movement of said second feeding means in the one direction by abutting said second engaging means, and a fourth abutment portion for regulating movement of said second feeding means in the opposite direction, said third and fourth abutment portions being so constructed as to abut against said second engaging means simultaneously.

2. A pin feed apparatus according to claim 1, further comprising third regulating means provided on said support means and engaging said second engaging means for regulating movement of said second feeding means in the directions substantially orthogonal to the sheet feed direction, said third regulating means having a fifth abutment portion for regulating movement of said second feeding means in the one direction by abutting said second engaging means, and a sixth abutment portion for regulating movement of said second feeding means in the opposite direction, said fifth and sixth abutment portions being so constructed to abut against said second engaging means simultaneously, said second engaging means selectively engaging said second or third regulating means.

3. A pin feed apparatus according to claim 1, further comprising an adjacent regulating means provided on said support means and engaging said first engaging means for regulating movement of said first feeding means in the directions substantially orthogonal to the sheet feed direction, said adjacent regulating means having a first adjacent abutment portion for regulating movement of said first feeding means in the one direction by abutting against said first engaging means, and a second adjacent abutment portion for regulating movement of said first feeding means in the opposite direction by abutting against said first engaging means, said first and second adjacent abutment portions being so constructed as not to abut against said first engaging means simultaneously, said first engaging means selectively engaging said first or third regulating means.

4. A pin feed apparatus according to claim 2, further comprising third regulating means provided on said support means and engaging said second engaging means for regulating movement of said second feeding means in the directions substantially orthogonal to the sheet feed direction, said third regulating means having a fifth abutment portion for regulating movement of said second feeding means in the one direction by abutting against said second engaging means, and a sixth abutment portion for regulating movement of said second feeding means in the opposite direction, said fifth and sixth abutment portions being so constructed as to abut against said second engaging means simultaneously, said second engaging means selectively engaging said second or third regulating means.

5. A pin feed apparatus according to claim 1, wherein said first engaging means includes a protrusion.

6. A pin feed apparatus according to claim 1, further comprising third feeding means disposed between said first and second feeding means for feeding the sheet by friction force.

7. A pin feed apparatus according to claim 1, wherein said first feeding means includes a rotary member having a pin on an outer periphery thereof.

8. A pin feed apparatus according to claim 7, wherein said first feeding means includes a hold member for holding said rotary member.

9. A pin feed apparatus according to claim 8, wherein said first engaging means is provided on said hold member.

10. A pin feed apparatus according to claim 1, wherein said second regulating means regulates said second feeding means to inhibit movement of said second feeding means.

11. A pin feed apparatus according to claim 1, further including bias means for causing said second engaging means to abut said third and fourth abutment portions.

* * * * *

UNITED STATES PATENT AND TRADEMARK OFFICE

CERTIFICATE OF CORRECTION

PATENT NO. : 5,080,514

DATED : January 14, 1992

INVENTOR(S) : HIROYUKI INOUE

It is certified that error appears in the above-identified patent and that said Letters Patent is hereby corrected as shown below:

ON THE TITLE PAGE

AT [56] REFERENCES CITED - U.S. PATENT DOCUMENTS:

Line 6, "Kindur, Sr." should read --Kondur, Jr.--;

AT [56] REFERENCES CITED - OTHER PUBLICATIONS:

Line 1, "Lost" should read --Low--; and

Line 2, "May, 1880," should read --May, 1980,--.

COLUMN 3:

Line 21, "left" should read --leaf--;

Line 27, "regulating)" should read --regulating means)--;

Line 28, "10*b*to" should read --10*b* to--.

COLUMN 4:

Line 22, "12*b* for" should read --12*b* (i.e., first and adjacent regulating means, respectively) for--.

UNITED STATES PATENT AND TRADEMARK OFFICE

CERTIFICATE OF CORRECTION

PATENT NO. : 5,080,514

DATED : January 14, 1992

INVENTOR(S) : HIROYUKI INOUE

It is certified that error appears in the above-identified patent and that said Letters Patent is hereby corrected as shown below:

COLUMN 5:

Line 6, "pin-wheel 7a" should read --pin-wheels 7a--.

COLUMN 6:

Line 31, "claim 2," should read --claim 3,--.

Signed and Sealed this

Twenty-ninth Day of June, 1993

Michael K. Kirk

*Attest:*

MICHAEL K. KIRK

*Attesting Officer*

*Acting Commissioner of Patents and Trademarks*